United States Patent [19]

Goubeaux et al.

[11] Patent Number: 4,693,151

[45] Date of Patent: Sep. 15, 1987

[54] CUTTING METHOD AND APPARATUS FOR STACKER

[75] Inventors: Donald E. Goubeaux, Miamisburg; Richard A. Miller, Cincinnati, both of Ohio

[73] Assignee: Monarch Marking Systems, Inc., Dayton, Ohio

[21] Appl. No.: 690,064

[22] Filed: Jan. 9, 1985

[51] Int. Cl.[4] ..... B65H 35/04; B26D 1/60

[52] U.S. Cl. ..... 83/23; 83/37; 83/94; 83/308; 83/314; 83/316; 83/508; 83/578

[58] Field of Search ..... 83/37, 156, 94, 93, 83/294, 315-317, 319, 320, 508, 578, 308, 23, 314

[56] References Cited

U.S. PATENT DOCUMENTS

| | | | |
|---|---|---|---|
| 2,550,191 | 4/1951 | Godat | 83/320 X |
| 3,516,313 | 6/1970 | Gudmestag | 83/317 X |
| 3,518,910 | 7/1970 | Munchback | 83/316 |
| 3,557,651 | 1/1971 | Byrley | 83/308 X |
| 3,633,447 | 1/1972 | Casida | 83/578 X |
| 3,808,928 | 5/1974 | Plegat | 83/314 X |
| 3,823,635 | 7/1974 | Carlson | 83/508 X |
| 3,874,650 | 4/1975 | Steigerwald | 271/4 |
| 3,881,383 | 5/1975 | Alverth et al. | 83/308 |
| 3,892,153 | 7/1975 | Kato | 83/294 X |
| 4,036,087 | 7/1977 | Braun | 83/94 X |
| 4,515,053 | 5/1985 | DuBois | 83/508 X |
| 4,525,088 | 6/1985 | Shipos et al. | 83/508 X |

FOREIGN PATENT DOCUMENTS

| | | | |
|---|---|---|---|
| 1240755 | 7/1971 | United Kingdom . | |
| 597514 | 3/1978 | U.S.S.R. | 83/308 |

*Primary Examiner*—Frank T. Yost

*Attorney, Agent, or Firm*—Joseph J. Grass

[57] ABSTRACT

There is disclosed a cutting mechanism for a stacker. A web of record members traveling in a longitudinal direction is severed by the cutting mechanism while the web is traveling. The cutting mechanism severs the web transversely to cut off the record members. The cutting mechanisms has cutters or knives that travel as a unit with respect to each other and with respect to the web in the longitudinal direction as the web travels.

16 Claims, 5 Drawing Figures

CUTTING METHOD AND APPARATUS FOR STACKER

FIELD OF THE INVENTION

This invention relates to the art of cutting apparatus, to method of cutting and stacking and to stackers.

SUMMARY OF THE INVENTION

A feature of the invention is to provide a relatively simple, low-cost, improved cutting mechanism for severing record members such as tags from a web, in which the mechanism cuts the web transversely while the web is moving longitudinally, wherein the cutting mechanism has coacting knives which travel as a unit together with the web while the web is traveling.

It is another feature of the invention to provide an improved cutting mechansim in which the record members are severed from the web transversely alternately in one direction and in the opposite direction.

It is another feature of the invention to use the web to cause the knives to travel as a unit with the web which the knives are cutting.

It is a feature of the invention to provide an improved stacker in which the traveling web is severed transversely while the web is in a stacker so that the severed record member is at or near the stacked position in the stacker when it is severed from the web.

Other features and advantages of the invention will be readily apparent to those skilled in the art.

DESCRIPTION OF THE PREFERRED EMBODIMENT

Figure 1:
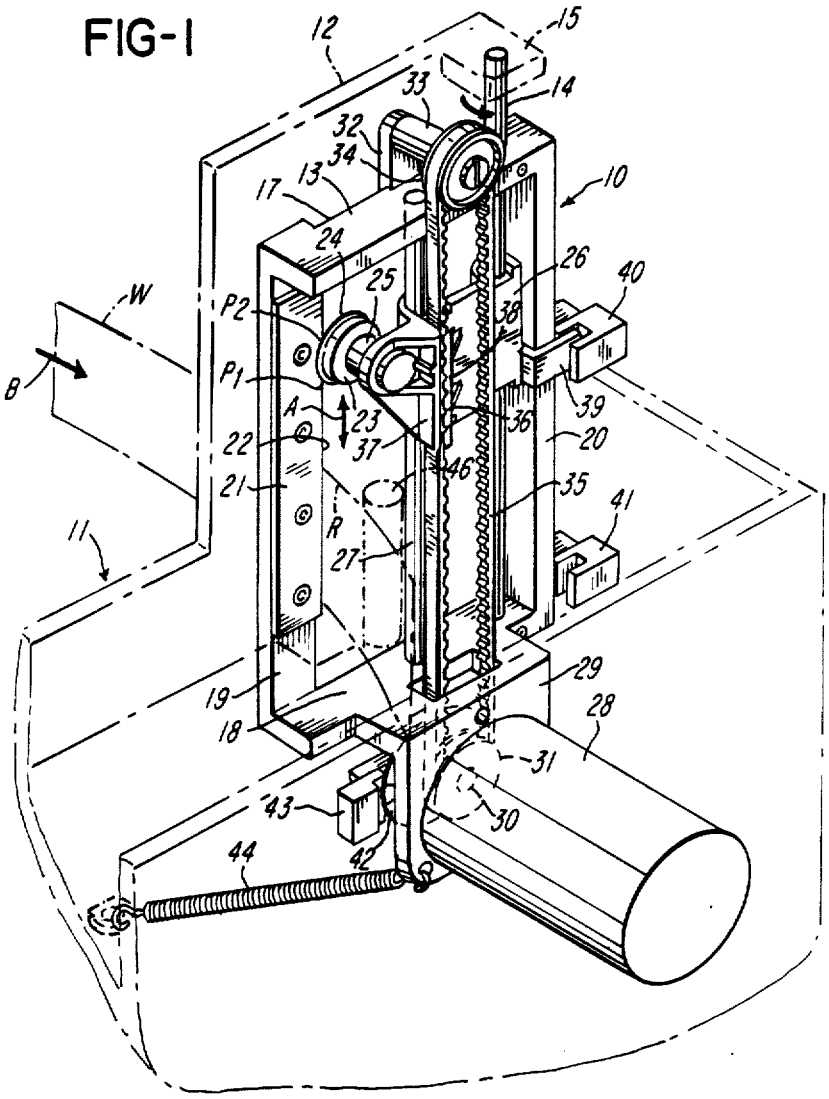
FIG. 1 is a perspective view of a cutting mechanism and a stacker.
Figure 2:
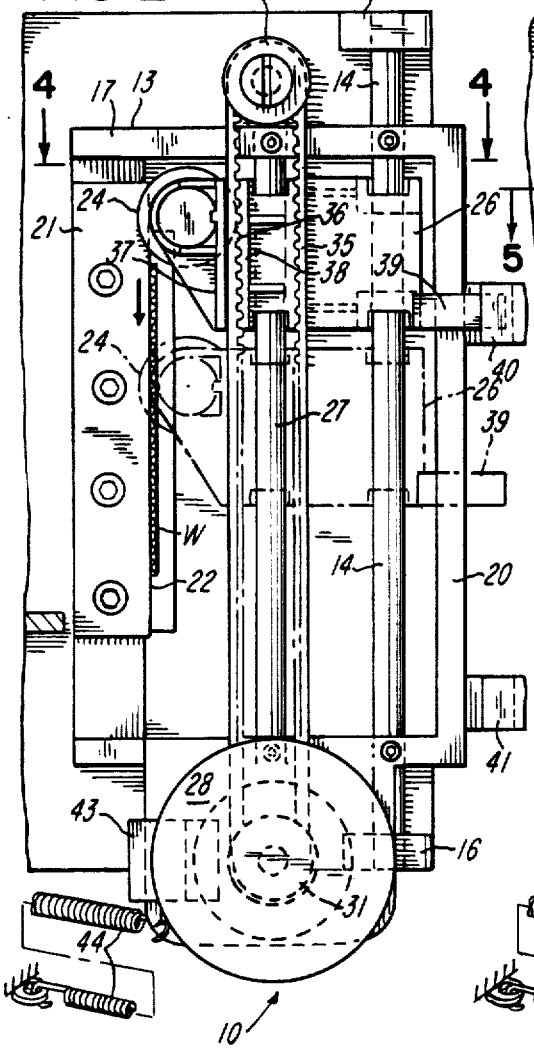
FIG. 2 is an elevational view of the cutting mechanism in an initial position.
Figure 3:
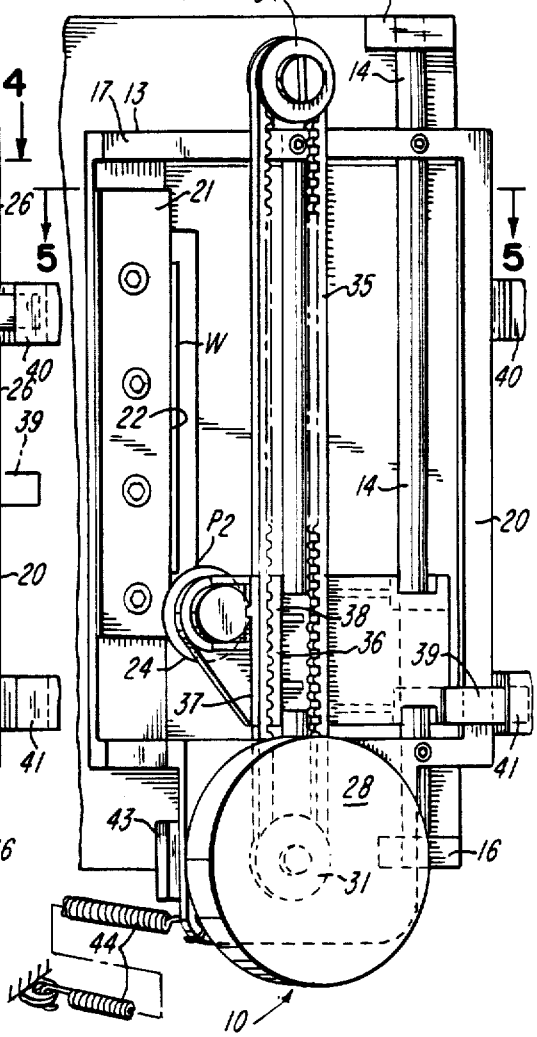
FIG. 3 is an elevational view of the cutting mechanism in a moved or actuated position.

With reference to FIG. 1, there is shown a cutting mechanism generally indicated at 10 and a stacker shown by phantom lines for clarity and generally indicated at 11. The cutting mechanism 10 includes a frame 12 and a movable mounting member 13 mounted on the frame 12 by a pivot or shaft 14. The pivot 14 is received in vertically spaced bearings 15 and 16 (FIG. 2). The mounting member 13 is generally rectangular and has spaced upper and lower portions or members 17 and 18 and spaced side portions or members 19 and 20. A cutter or knife 21 having a cutting edge 22 is removably secured to the side member 19. The knife 21 and its edge 22 are preferably straight. A generally annular knife 23 has a peripheral cutting edge 24 which cooperates with the edge 22 to sever a record member R from a longitudinally extending web W. The knife 23 can travel in the directions shown by the double headed arrow A. In FIG. 1, the knife 23 is shown to be above the web W and will sever the record R therefrom as the knife travels downwardly. The knife 23 is rotatable on a pivot 25 mounted by a slide 26. The slide 26 is mounted for vertical sliding movement by a shaft or guide 27 and by the pivot 14. The pivot 14 and the guide 27 are parallel to each other. End portions of the guide 27 are received by upper and lower members 17 and 18. The knife 23 rotates as the slide 26 moves up and down due to cutting coaction of the knives 21 and 23. Thus, the cutting edges 22 and 23 sharpen each other.

A reversible electric motor 28 is mounted to a depending flange 29 of the bottom member 18. The motor 28 has a shaft 30 to which a toothed pulley 31 is secured. An upwardly extending flange 32 and a pivot 33 rotatably mounts a toothed pulley 34. A toothed endless belt 35 is trained about the pulleys 31 and 34 under tension. The belt passes through an opening in the member 18. A portion 36 of the belt 35 is positioned between a slide portion 37 and a toothed slide portion 38. This coupling between the belt 35 and the slide 26 assures that there is not slippage therebetween. As the motor shaft 30 rotates in one direction, the slide 26 and the knife 23 are moved downwardly, and as the motor shaft 30 rotates in the opposite direction the slide 26 and the knife 23 are moved upwardly. As shown, the knife edge 22 is in contact with the knife edge 24 along a chord of the knife edge 24. Thus, the knife edges 22 and 24 make edge contact at two points P1 and P2. Point P1 effects cutting when the knife 23 moves downwardly and point P2 effects cutting when the knife 23 moves upwardly. An element 39 is sensed at its upper position by a sensor 40 to stop the motor 28 and upward travel of the slide 26 and at its lower position by a sensor 41 to stop the motor 28 and downward travel of the slide 26. A disc 42 having graduations (not shown) is sensed by a sensor 43. The sensor 43 indicates to the controls (not shown) the distance through which the slide 26 has traveled.

Figure 4:
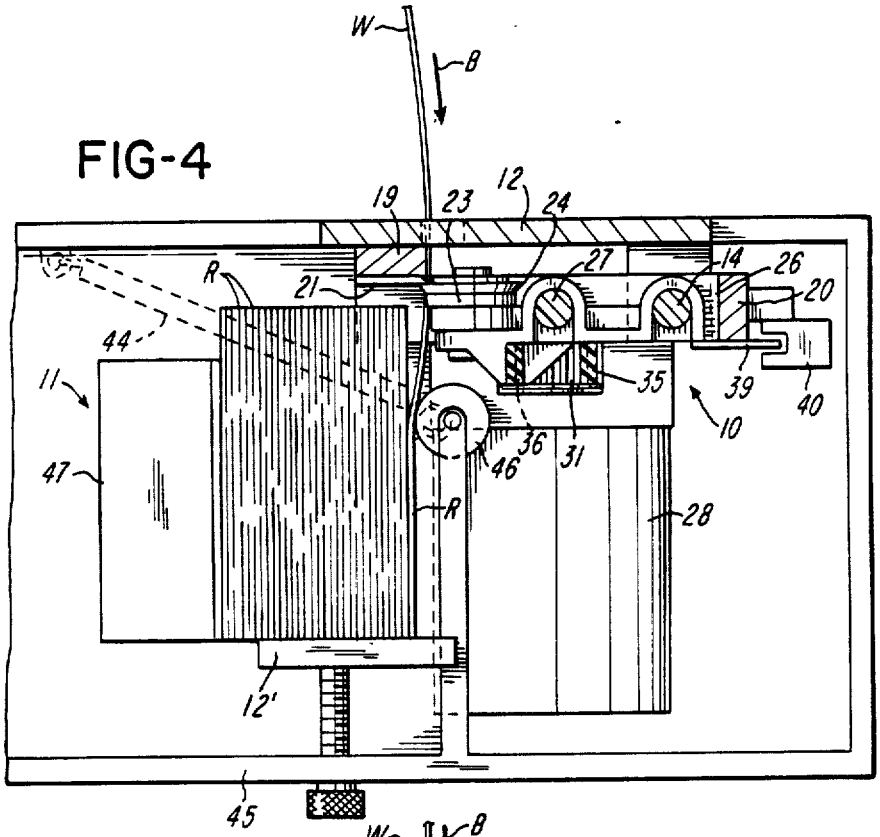
FIG. 4 is a sectional view taken generally along line 4—4 of FIG. 2.
Figure 5:
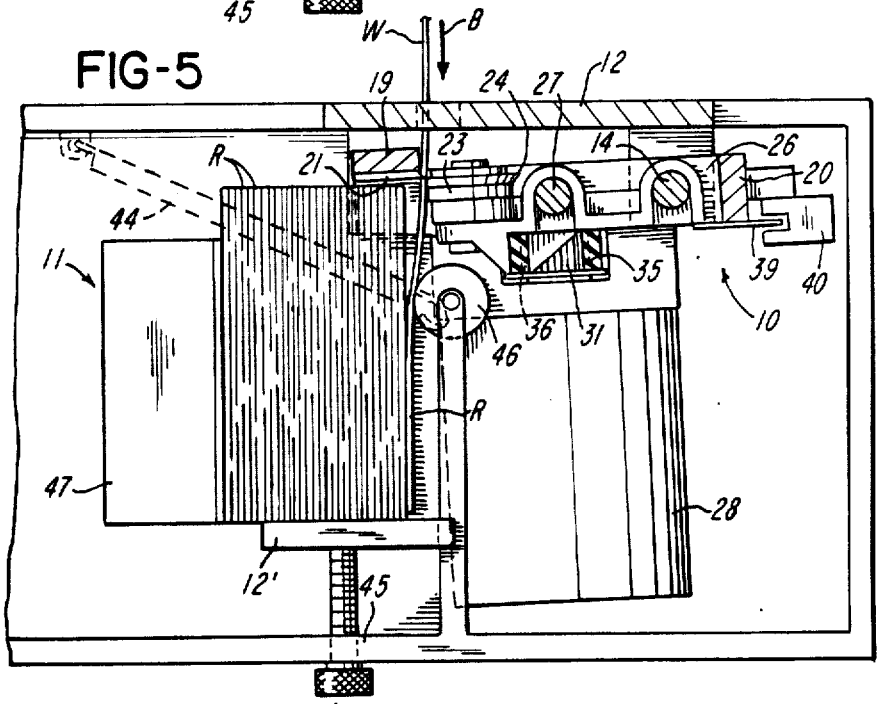
FIG. 5 is a sectional view taken generally along line 5—5 of FIG. 3.

The cutting mechanism 10 cuts the record members R from the web W while the web W is traveling longitudinally in the direction of arrow B. As shown the web W projects through an opening defined by members 17, 18, 19 and 20. The web W imparts movement to the mounting member 13 and the components mounted by the mounting member 13 as the web W travels as best illustrated by comparing FIGS. 4 and 5. FIG. 4 shows the side member 19 in abutment with the stationary frame 12 at an initial position. While cutting, the knives 21 and 23 engage the traveling web W. Movement is imparted to the member 13 through the knives 21 and 23 as the knives 21 and 23 are cutting. As the web W continues to travel longitudinally, the knives 21 and 23 cut through the web transversely or laterally, preferably perpendicularly to the longitudinal direction of travel of the web W. During the cutting, the member 13 and the components it mounts are pivoted counterclockwise about pivot 14 to an actuated position shown in FIG. 5. As soon as the knife 23 has traveled upwardly far enough to clear the web W, a tension spring 44 pivots the member 13 clockwise about the pivot 14. As soon as the cutting mechanism 10 is in its initial position again it is ready to cut another record member R from the web W. Assuming that the knife 23 has moved upwardly to cut off one record member R, the next record member R is cut off by moving the knife 23 downwardly. Thus, the knives 21 and 23 cut on both the upward and the downward movements or strokes of the knife 23.

When the record member R has been cut from the web W, the record member R is at or near its final or stacked position in the stacker 11. In this way the movement and positioning of the record members R is controlled. There is no tendency of severed record members R to become disoriented as could be the case if the record members were severed from the web outside the stacker 11. The record member R encounters a vertically extending roller 46 in the stacker 11 even before the record member R is severed. The roller 46 thus provides low friction guiding of the end portion of the web W. The record members R accumulate in the stacker 11 behind a weight 47. The leading ends of the record member R abut an adjustable wall 12'. As a record member R is moving into position behind the last stacked record member R in the stack the friction between the arriving record member R moves the last stacked record member R fully against the adjustable wall 12'.

The invention has been disclosed using such terms as upward, downward, vertical and so on, but these terms are considered to be relative only and the invention is not to be limited thereby.

Other embodiments and modifications of the invention will suggest themselves to those skilled in the art, and all such of these as come within the spirit of this invention are included within its scope as best defined by the appended claims.

We claim:

1. Apparatus including a stationary frame, a cutting mechanism for cutting a longitudinally extending traveling web transversely to sever record members from the web and having a generally annular rotatable knife, an elongate knife in contact with the rotatable knife generally along a chord of the rotatable knife, means mounting the knives on the frame for movement as a unit with the traveling web, means mounted on the mounting means for moving the rotatable knife in a direction generally parallel to the elongate knife to cut a generally rectangular record member from the traveling web while the web and the cutting mechanism are traveling longitudinally as a unit, and wherein the traveling web moves the mounting means during operation of the moving means solely by engagement of the knives with the web.

2. Apparatus as defined in claim 1, wherein the mounting means includes a mounting member and means for pivotally mounting the mounting member to the frame, wherein the elongate knife is secured to the mounting member, and the mounting means further includes means for mounting the rotatable knife on the mounting member for generally linear movement.

3. A cutting mechanism as defined in claim 2, wherein the moving means includes an electric motor coupled to the rotatable knife.

4. A cutting mechanism as defined in claim 3, wherein the electric motor is of the reversible type.

5. A cutting mechanism as defined in claim 2, wherein the mounting member moves from an initial first position to a second position while the knives are cutting, and means for returning the mounting member to the initial position following cutting.

6. A cutting mechanism as defined in claim 2, wherein the returning means includes a spring.

7. A cutting mechanism as defined in claim 1, wherein the mounting means includes a mounting member, means for pivotally mounting the mounting member to the frame, wherein the elongate knife is secured to the mounting member, guide means on the mounting member, and means for mounting the rotatable knife on the pivotal means and on the guide means for guided linear movement.

8. A cutting mechanism as defined in claim 7, wherein the mounting member moves from an initial first position to a second position while the knives are cutting, and means for returning the mounting member to the initial position following cutting.

9. In combination, apparatus as defined in claim 1 and a stacker for receiving record members, and means for guiding the record members one-by-one into the stacker.

10. The combination defined in claim 9, wherein the guiding means includes a rotatable roll adjacent the cutting mechanism.

11. Apparatus as defined in claim 1, including a stacker adjacent the cutting means for receiving an end portion of the web while the knives are cutting a record member from the end portion of the web.

12. Apparatus as defined in claim 11, wherein the stacker includes an adjustable wall against which terminal ends of the cut record members abut.

13. Method of cutting and stacking record members, comprising the steps of: providing a cutting mechanism having a generally annular rotatable knife and an elongate knife in contact with the rotatable knife generally along a chord of the rotatable knife, moving the rotatable knife relative to the elongate knife, advancing a web into engagement with the moving knives and moving the knives as a unit together with the web solely by engagement of the knives while the rotatable knife is moving to sever a generally rectangular record member from the web, providing a stacker for accumulating a stack of tags, and wherein the knives sever a record member from the web while a portion of the web is in the stacker.

14. Method as defined in claim 13, including the step of adjusting the stacker to accept record members of different lengths.

15. Method as defined in claim 13, and guiding the web into the stacker using a roll.

16. Method as defined in claim 13, including the steps of adjusting the stacker to accept record members of different length, and guiding the web into the stacker using a roll.

* * * * *

UNITED STATES PATENT AND TRADEMARK OFFICE

CERTIFICATE OF CORRECTION

PATENT NO. : 4,693,151

DATED : September 15, 1987

INVENTOR(S) : Donald E. Goubeaux and Richard A. Miller

It is certified that error appears in the above-identified patent and that said Letters Patent are hereby corrected as shown below:

Column 2, line 16, "not" should be --no--. Column 4, line 3, "2" should be --5--; line 11, after "pivotal" --mounting-- has been omitted.

Signed and Sealed this

Fourteenth Day of June, 1988

*Attest:*

DONALD J. QUIGG

*Attesting Officer*

*Commissioner of Patents and Trademarks*